United States Patent [19]

Vaden

[11] 4,431,246

[45] Feb. 14, 1984

[54] INSULATION PIERCING CONTACT

[75] Inventor: James L. Vaden, Weaverville, N.C.

[73] Assignee: Akzona Incorporated, Asheville, N.C.

[21] Appl. No.: 252,645

[22] Filed: Apr. 9, 1981

[51] Int. Cl.[3] ..... H01R 4/26

[52] U.S. Cl. ..... 339/97 R; 339/97 P

[58] Field of Search ..... 339/97 R, 97 C, 97 P, 339/98, 99 R, 99 L

[56] References Cited

U.S. PATENT DOCUMENTS

| | | | |
|---|---|---|---|
| 3,816,818 | 6/1974 | Meier | 339/99 R |
| 3,860,316 | 1/1975 | Hardesty | 339/99 R |
| 4,089,580 | 5/1978 | Huffnagle et al. | 339/99 R |
| 4,211,462 | 7/1980 | Wolfthal | 339/97 R |
| 4,270,831 | 6/1981 | Takahashi | 339/99 R |
| 4,352,537 | 10/1982 | Guelden | 339/97 P |

FOREIGN PATENT DOCUMENTS

| | | | |
|---|---|---|---|
| 3650 | 8/1979 | European Pat. Off. | 339/97 P |
| 2455354 | 5/1975 | Fed. Rep. of Germany | 339/99 R |
| 2542219 | 3/1977 | Fed. Rep. of Germany | 339/99 R |

*Primary Examiner*—John McQuade
*Assistant Examiner*—Gary F. Paumen
*Attorney, Agent, or Firm*—Francis W. Young; David M. Carter

[57] ABSTRACT

An improved insulation piercing contact for use in an electrical connector is provided. The contact is made of a sheet metal stamping, which includes a top portion for making electrical contact with a first conductor, and a bottom portion which includes at least two tines. Each tine is bevelled and has a bottom edge which pierces the insulation of a second conductor and makes contact. The tines may project away from one of the planar surfaces of the contact.

9 Claims, 7 Drawing Figures

INSULATION PIERCING CONTACT

BACKGROUND OF THE INVENTION

This invention relates to electrical connectors. More particularly, it relates to insulation piercing contacts useful in electrical plugs, especially for the telephone industry.

In recent years, the telephone industry has begun to use modular plugs and jacks to make connections between such things as a telephone drop cord and a hand set. The plug normally includes a monolithic plastic housing having a number of groove-like openings in its front end and top side for receiving a like number of contacts which are terminated to insulated conductors. The top surfaces of these contacts are adapted to make electrical connections with the contacts of an associated jack. A cable having a plurality of insulated conductors is received in the back end of the housing.

An example of such a plug which has become somewhat of a standard in the industry is described in U.S. Pat. No. 3,860,316 in the name of Hardesty. The Hardesty patent shows an insulation piercing contact received in the plastic housing. Each contact includes a pair of arrowhead-shaped pointed barbs which pierce the insulation about the conductor as well as the conductor itself. Furthermore, these pointed barbs may actually pierce into the bottom side of the plastic housing. One of the problems of the industry in utilizing this type of contact in this housing is that manufacturers have not been able to use inexpensive solid and stranded copper conductors in cable which is thusly been terminated.

The standard conductor material for this type of telephone cord is tinsel, a very soft material, and thus easily penetrated by the barbs of the contact. One of the problems of using tinsel conductor in lieu of ordinary stranded or solid copper conductor is that it is very expensive. Also, since the tinsel is a soft material, it is easily broken. Thus, it is desirable to utilize a termination system which may be used with ordinary solid or stranded copper conductor.

Another problem in using a contact such as that shown in the Hardesty patent is that the contact can readily work its way free from the conductor because of this arrowhead pointed shape of the insulation piercing members.

OBJECTS OF THE INVENTION

It is one object of this invention to provide an improved electrical contact.

It is another object to provide improved insulation displacement electrical contact.

It is still another object to provide an electrical connector which utilizes an improved contact insulation displacement contact.

It is still another object to provide an electrical connector with a contact which automatically aligns with and terminates to a conductor.

It is a further object to provide a telephone plug termination system which can be used with solid or stranded metal conductors.

SUMMARY OF THE INVENTION

In accordance with one form of this invention, there is provided an electrical contact for use in an electrical connector housing. The contact is stamped from relatively thin sheet metal. It includes one surface for making electrical contact with a first conductor. At least a first and a second tine are connected to a body portion of the contact. The tines have bottom edges which are adapted to pierce the insulation of a second conductor so that a portion of the tines make electrical contact with the second conductor.

In one form of the invention, the tines are bevelled, thus their thickness tapers from thick where they are attached to the body portion to thin at the bottom edges.

In another form of the invention, the first tine projects away from the plane of one side of the body portion and the second tine projects away from the plane of the opposite side of the body portion.

In each of these embodiments as well as combinations thereof, an insulated conductor is contacted by the edges of the tines and upon pressure from the top of the contact, the insulation is displaced and the tines crimped to the conductor.

BRIEF DESCRIPTION OF THE DRAWINGS

The subject matter which is regarded as the invention is set forth in the appended claims. The invention itself, however, together with further objects and advantages thereof, may be better understood by reference to the following descriptions taken in conjunction with the accompanying drawings, in which:

DESCRIPTION OF THE PREFERRED EMBODIMENTS

Figure 1:
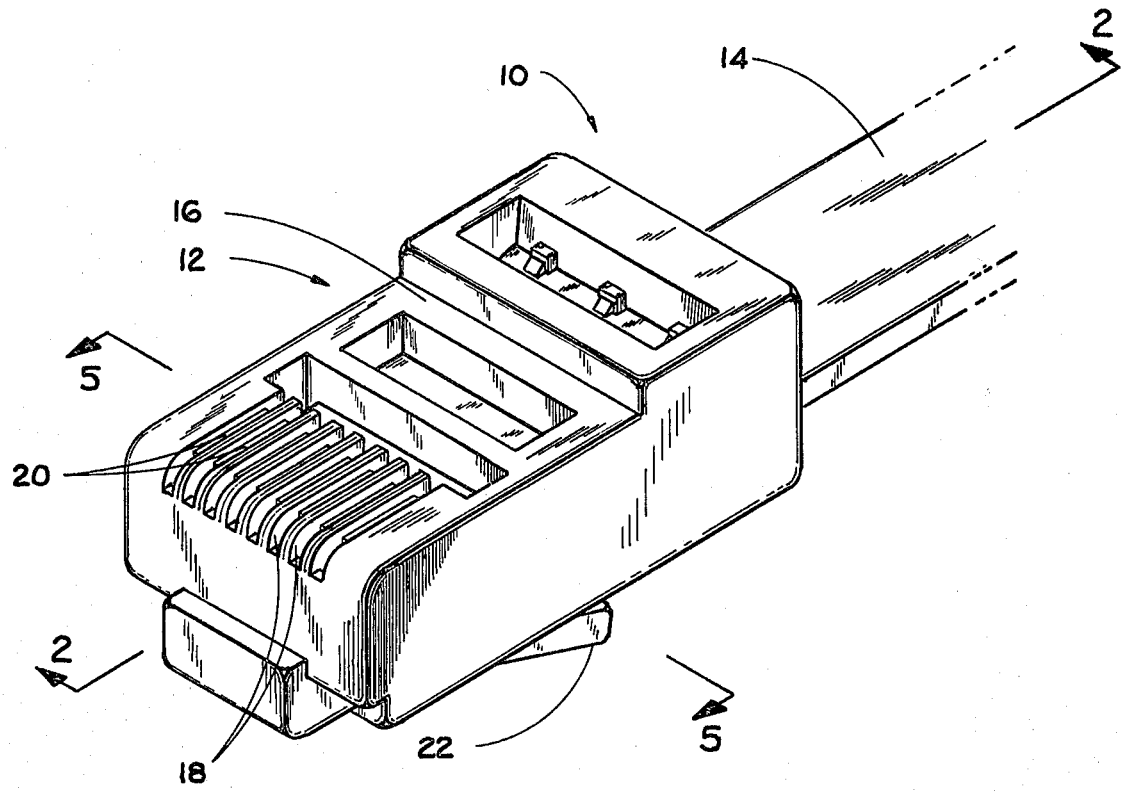
FIG. 1 is a pictorial view of the electrical connector assembly incorporating some of the features of the subject invention.

Referring now more particularly to FIG. 1, there is provided electrical connector assembly 10 including plug 12 and and flat multiconductor electrical cable 14. Plug 12 includes plastic housing 16. An acceptable housing for use herein is described in U.S. Pat. No. 4,211,462, assigned to Stewart Stamping Corporation. Connector 12 includes a plurality of openings 18 on its top and front providing slots for receiving a plurality of contacts 20. The contacts are adapted to terminate to the wires which are included in cable 14, and also to make electrical connection with the contacts of an associated jack or female connector (not shown). Locking tab 22 projects from the bottom of the plug for locking the plug into the associated jack.

Figure 2:
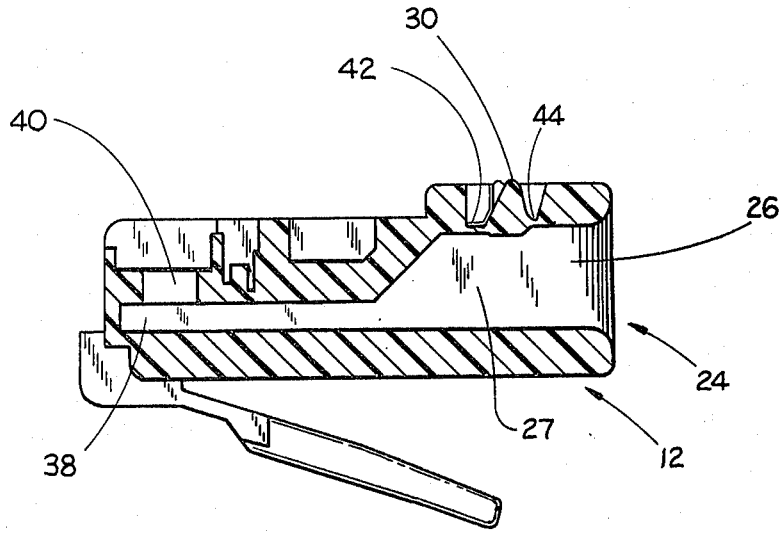
FIG. 2 is a sectional side view of the connector housing taken through lines 2—2 of FIG. 1, however, with the cable and contacts removed.

Referring now to FIG. 2, which is a sectional view of the housing of FIG. 1 taken through lines 2—2 but prior to the housing being loaded with the contacts 20 and the cable 14. The housing 12 includes rear portion 24 having opening 26 for receiving a multiconductor cable.

Figure 3:
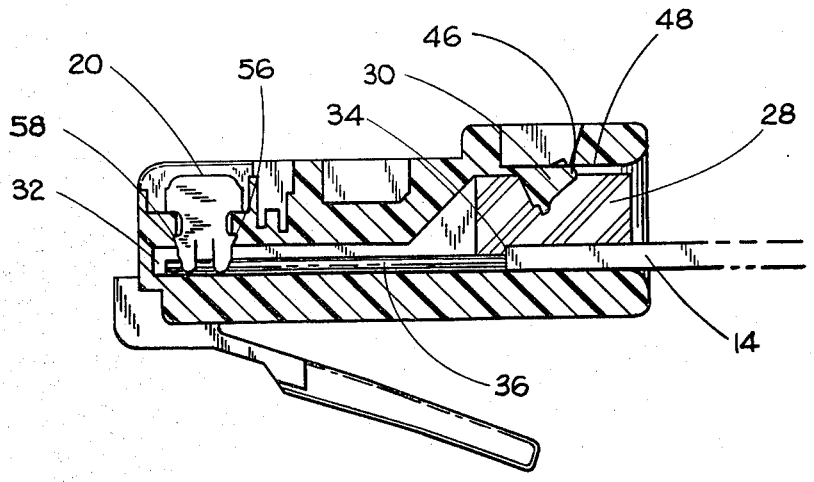
FIG. 3 is a sectional side view of the connector assembly taken along lines 2—2 of FIG. 1 with the contacts and cable included.

The cable 14 is shown received in housing 12 in FIG. 3. In this embodiment, cable 14 is flat. Since the connector housing was originally designed to be used with round cable, filler block 28 is also included between flat cable 14 and the strain relief mechanism 30.

The cable jacket is stripped back from the end 32 of the cable and the excess is severed at 34, so that the individual insulated conductors 36 are exposed and may be terminated by contacts 20. The insulated conductors 36 are received in slots 38.

Figure 5:
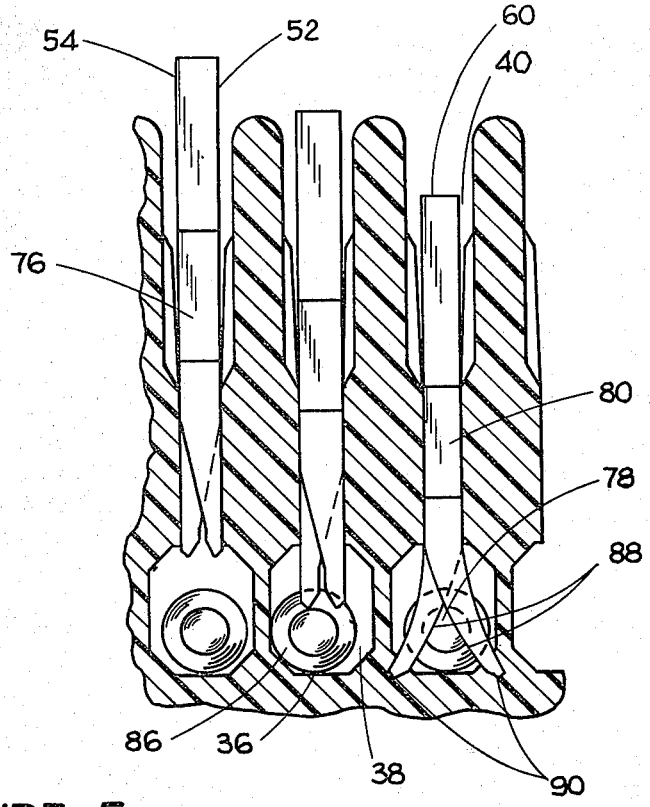
FIG. 5 is a sectional view of the connector of FIG. 1 taken through lines 5—5 showing the contact of FIG. 4 in three separate stages of being loaded into the connector.

The relationship between the slots 38 and the conductors 36 may be better seen in reference to FIG. 5. As can be seen in this embodiment, the conductor receiving slots 38 are somewhat wider than the contact receiving slots 40. Also, it should be noted that these conductor receiving slots are, in this embodiment, somewhat wider than the diameter of the insulated conductors. Thus, the conductors may not be perfectly centered within slots 38.

As can be seen from FIGS. 2 and 3, the connector housing includes a cable strain relief mechanism 30, which, in its position in FIG. 2, is attached to the remainder of the housing by a hinge 42 and a weakened section 44.

FIG. 3 shows this strain relief machanism having been pressed into cavity 27, with the weakened section 44 reversed and the head 46 resting against shoulder 48 of the housing, thus locking the strain relief mechanism in place. A more complete description of the operation and make-up of this strain relief is set forth in the aforementioned U.S. Pat. No. 4,211,462, which is hereby incorporated by reference.

Figure 4:
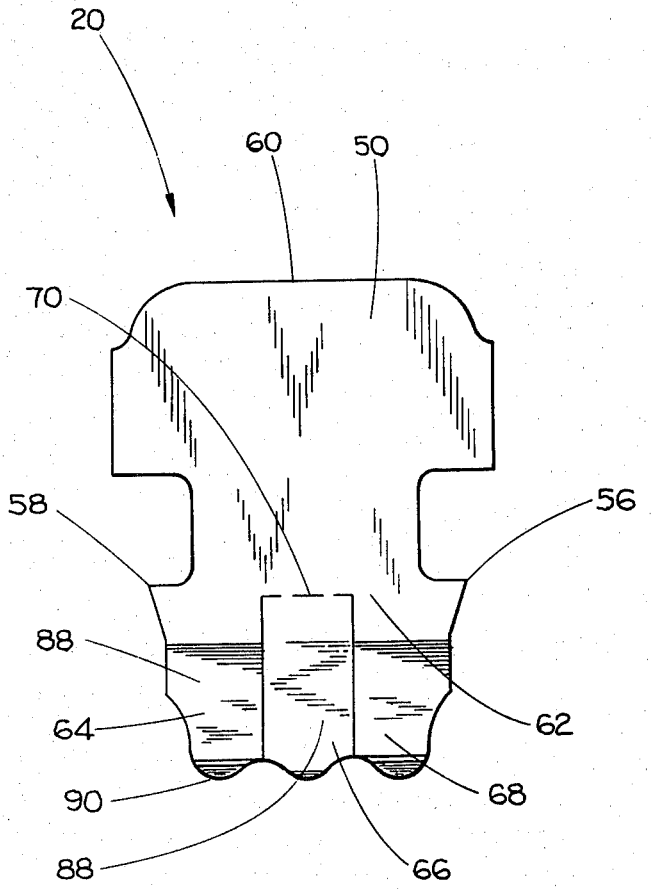
FIG. 4 is a plan view of the electrical contact incorporating some of the features of the present invention.

As stated previously, contact 20 is received in slot 40 for termination to the conductor 38. Contact 40 is best described in reference to FIGS. 4 and 5. Contact 20 includes body portion 50 having relatively flat planar surfaces 52 and 54. Barbs 56 and 58 project from the sides of the contact for helping to secure the contact in the plastic housing as shown in FIG. 3. The top portion 60 of the contact is adapted to make electrical contact along its narrow width with an associated jack contact (not shown). The bottom portion 62 of the contact, in this embodiment, includes first, second and third tines which are indicated as 64, 66 and 68, respectively. These tines are connected to the body portion approximately at position 70. However, as can be seen, the tines are integral with the body portion of the contact.

Figure 7:
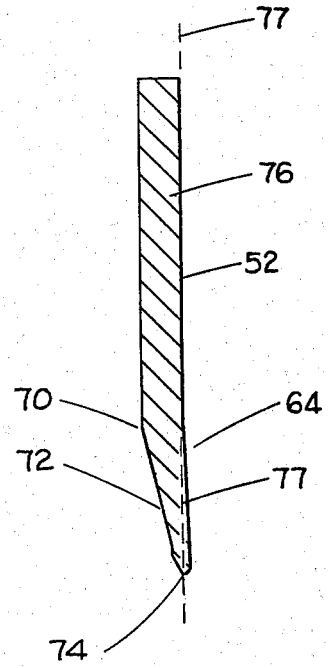
FIG. 7 is a sectional view of one of the tines in the contact shown in FIG. 4.

As shown in FIG. 7, the short width of each tine is bevelled along line 72 between their body portion connection point 70 to bottom edge 74. As is apparent in reference to FIG. 5, each adjacent tine is bevelled in a mirrored relationship to the other. Furthermore, adjacent tines project outwardly somewhat from the plane of the surfaces 52 and 54 of the body portion, again in an alternating fashion. As can be seen from FIGS. 5 and 7, contact 76, being shown in its stamped condition prior to termination to the conductor, has its tines project only slightly from the plane 77 of the surface 52 of the body portion. However, once the contact is terminated to the conductor 78, as shown in reference to contact 80, the tines have a more exaggerated projection from the plane of the surfaces of the body portion of the contact. Thus, the tines provide both a gas tight termination and a spring force on the conductor due to the spreading of the tines.

Figure 6:
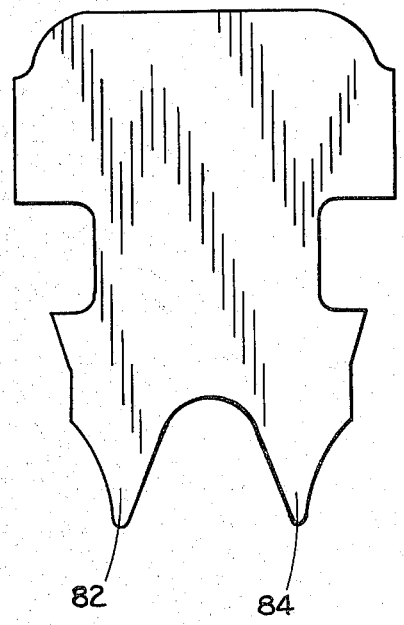
FIGURE 6 PRIOR ART
FIG. 6 is a plan view of a prior art contact.

As can be seen from FIG. 5, the conductor 36 has a smaller diameter than the width across slot 38. Thus, the conductor may not be perfectly aligned with respect to the contact. If a prior art contact, such as the one shown in FIG. 6, is utilized in this situation, and if the conductor is in the position shown in the middle slot of FIG. 5, it is quite possible that the barbs 82 and 84 of FIG. 6 will completely miss the conductor 78 during an attempt at termination. The contact, which is the subject of this invention, by having the bevelling feature as well as having a slight angle of inclination with respect to the plane main body portion of the contact, readily aligns itself with the conductor, pierces the insulation 86, and scores the conductor 78, making a crimped and spring termination with fresh copper from the conductor along a rather large surface area of the tines indicated generally at 88. The bottom edges 90 of the tines may be somewhat parallel to the plane of mid-body portion. However, in this embodiment, the bottom edges 90 of the tines are rounded to increase their capacity for piercing the insulation as well as scoring the conductor.

Furthermore, these sharp edges 90 penetrate into the plastic housing to aid in locking the contact into the housing as well as providing strain relief for the individual conductors. With these long edges 90, as opposed to the sharp pointed barbs of the prior art contact shown in FIG. 6, the contact is made much more difficult to loosen. Also, the surface area of contact between the tines and the conductor itself is much larger in this applicant's contact than the prior art contact of FIG. 6. In addition, it is believed that by using this technique, solid metal and stranded wires may be terminated and that expensive tinsel wire will no longer need to be used in these situations.

From the foregoing description of the illustrative embodiment of the invention, it will be apparent that many modifications may be made therein. It will be understood, therefore, that this embodiment of the invention is intended as an exemplification of the invention only, and that the invention is not limited thereto. It is to be understood, therefore, that it is intended that the impending claims are to cover all the modifications that shall fall within the true spirit and scope of the invention.

I claim:

1. An electrical connector comprising:

a thin sheet metal stamping, said stamping including a body portion having a substantially flat top surface adapted to make electrical contact with a first conductor; said stamping further including at least a first and a second tine connected to said body portion, said tines being adjacent to one another, each tine having a pair of side surfaces, at least a portion of the opposite side surfaces of adjacent tines are bevelled forming bottom edges adapted to score opposite sides of an elongated second conductor so that the side surfaces which are bevelled are adapted to make contact with and terminate to the elongated second conductor, said tines being thinner at said bottom edges than where said tines are connected to said body portion, said tines being in substantially the same plane as said body portion when said tines are not in contact with the elongated second conductor with said bottom edges of adjacent tines being on opposite sides of the widest central sectional plane of said stamping.

2. An electrical contact as set forth in claim 1, further including a pair of barbs projecting from the sides of said body portion of said stamping for retaining said stamping in an electrical connector body.

3. An electrical connector as set forth in claim 1, further including a third tine connected to said body portion adjacent to said second tine, said third tine being bevelled on the same side surface as said first tine.

4. An electrical connector as set forth in claim 1, wherein said bottom edges of said tines are curved to aid in cutting ability.

5. An electrical assembly comprising:

a housing having a front portion and a rear portion; an electrical cable; a first opening located in the rear portion of said housing receiving said electrical cable, said cable having at least one elongated conductor; at least one electrical contact; a second opening in the top of the front portion of said housing, said second opening receiving said electrical contact; said contact formed as a thin sheet metal stamping, said stamping including a body portion having a substantially flat top surface, said stamping further including at least a first and a second tine adjacent to one another, each tine being connected to said body portion, each tine having a pair of side surfaces, at least a portion of the opposite side surfaces of adjacent tines are bevelled forming bottom edges adapted to score opposite sides of said elongated conductor, the side surfaces of said tines which are bevelled making contact with and being terminated to said elongated conductor, said tines being thinner at said bottom edges than where said tines are connected to said body portion, said bottom edges of said adjacent tines substantially flairing out in opposing directions away from the plane of said body portion and penetrating into said housing so that the distance between the bottom edges of said first and second tines is substantially greater than the thickness of said stamping.

6. An electrical assembly as set forth in claim 5, wherein said cable is substantially a flat cable.

7. An electrical assembly as set forth in claim 5, further including a pair of barbs projecting away from the side of said contact for retaining said contact in said housing.

8. An electrical assembly as set forth in claim 5, further including a third tine adjacent to said second tine and being bevelled in substantially a similar manner to said first tine, said third tine flairing out from the plane of said body portion in the same direction and same manner as said first tine.

9. An electrical assembly as set forth in claim 5, wherein said bottom edges of said tines are curved.

* * * * *